US010352090B2

(12) United States Patent
Briese et al.

(10) Patent No.: US 10,352,090 B2
(45) Date of Patent: Jul. 16, 2019

(54) WINDOW SPACER FRAME PUNCH ASSEMBLY

(71) Applicant: GED Integrated Solutions, Inc., Twinsburg, OH (US)

(72) Inventors: William Briese, Hinckley, OH (US); Paul A. Hofener, Parma, OH (US)

(73) Assignee: GED Integrated Solutions, Inc., Twinsburg, OH (US)

( * ) Notice: Subject to any disclaimer, the term of this patent is extended or adjusted under 35 U.S.C. 154(b) by 121 days.

(21) Appl. No.: 15/265,382

(22) Filed: Sep. 14, 2016

(65) Prior Publication Data

US 2017/0074030 A1 Mar. 16, 2017

Related U.S. Application Data

(60) Provisional application No. 62/218,667, filed on Sep. 15, 2015.

(51) Int. Cl.

| | |
|---|---|
| ***E06B 3/673*** | (2006.01) |
| ***B21D 39/03*** | (2006.01) |
| ***B21D 28/24*** | (2006.01) |
| ***B21D 53/74*** | (2006.01) |

(52) U.S. Cl.

CPC ..... *E06B 3/67308* (2013.01); *B21D 28/243* (2013.01); *B21D 53/74* (2013.01); *E06B 3/67365* (2013.01)

(58) Field of Classification Search

CPC ... E06B 3/67308; E06B 3/6736; B21D 53/74; B21D 28/243

See application file for complete search history.

(56) References Cited

U.S. PATENT DOCUMENTS

| | | | |
|---|---|---|---|
| 4,078,462 A | 3/1978 | Lancaster | |
| 4,644,836 A | 2/1987 | Wepner | |
| 9,279,283 B2 * | 3/2016 | Briese | E06B 3/67308 |

(Continued)

FOREIGN PATENT DOCUMENTS

| | | |
|---|---|---|
| GB | 1259917 | 1/1972 |

OTHER PUBLICATIONS

International Search Report for International Application No. PCT/US2016/051898 dated Nov. 22, 2016 (6 pages).

(Continued)

*Primary Examiner* — John C Hong

(74) *Attorney, Agent, or Firm* — Tarolli, Sundheim, Covell & Tummino LLP; John A. Yirga, Esq.

(57) ABSTRACT

An apparatus and method is provided for forming a spacer frame assembly used in the construction of insulating glass unit windows. The apparatus comprises a head arrangement having a body with first and second ends, the first end for coupling to a cylinder that advances and retracts the head arrangement in a reciprocating motion during operation. The second end includes an annular wedge-shaped ridge for coupling to a second annular wedge-shaped ridge of a die support, collectively the wedge-shaped ridge and second wedge-shaped ridge form a contact region to form a torus surface. The die support has at least one die for engaging a spacer frame assembly during operation. The apparatus further comprises a collar having a torus-shaped recess corresponding with the torus surface to nest and couple the body to the die support.

20 Claims, 21 Drawing Sheets

(56) References Cited

U.S. PATENT DOCUMENTS

| | | | | |
|---|---|---|---|---|
| 9,428,953 | B2 * | 8/2016 | Briese | E06B 3/66309 |
| 9,534,439 | B2 * | 1/2017 | Briese | E06B 3/67326 |
| 9,765,564 | B2 * | 9/2017 | Briese | E06B 3/663 |
| 2008/0295567 | A1 | 12/2008 | Thielges et al. | |
| 2009/0320550 | A1 | 12/2009 | Lee et al. | |
| 2010/0107846 | A1 | 5/2010 | Lee et al. | |
| 2014/0260491 | A1 | 9/2014 | Briese | |

OTHER PUBLICATIONS

European Search Report for International Application No. PCT/US2016/051898 dated Apr. 4, 2019 (5 pages).

* cited by examiner

WINDOW SPACER FRAME PUNCH ASSEMBLY

CROSS REFERENCES TO RELATED APPLICATIONS

The following application claims priority under 35 U.S.C. § 119(e) to U.S. Provisional Patent Application Ser. No. 62/218,667 filed Sep. 15, 2015 entitled WINDOW SPACER FRAME PUNCH ASSEMBLY. The above-identified application is incorporated herein by reference in its entirety for all purposes.

TECHNICAL FIELD

The present disclosure relates generally to insulating glass units and more particularly to a method and apparatus for fabricating a spacer frame for use in making a window.

BACKGROUND

Insulating glass units (IGUs) are used in windows to reduce heat loss from building interiors during cold weather. IGUs are typically formed by a spacer assembly sandwiched between glass lites. A spacer assembly usually comprises a frame structure extending peripherally about the unit, a sealant material adhered both to the glass lites and the frame structure, and a desiccant for absorbing atmospheric moisture within the unit. The margins or the glass lites are flush with or extend slightly outwardly from the spacer assembly. The sealant extends continuously about the frame structure periphery and its opposite sides so that the space within the IGUs is hermetic.

There have been numerous proposals for constructing IGUs. One type of IGU was constructed from an elongated corrugated sheet metal strip-like frame embedded in a body of hot melt sealant material. Desiccant was also embedded in the sealant. The resulting composite spacer was packaged for transport and storage by coiling it into drum-like containers. When fabricating an IGU the composite spacer was partially uncoiled and cut to length. The spacer was then bent into a rectangular shape and sandwiched between conforming glass lites.

Perhaps the most successful IGU construction has employed tubular, roll formed aluminum or steel frame elements connected at their ends to form a square or rectangular spacer frame. The frame sides and corners were covered with sealant (e.g., a hot melt material) for securing the frame to the glass lites. The sealant provided a barrier between atmospheric air and the IGU interior which blocked entry of atmospheric water vapor. Particulate desiccant deposited inside the tubular frame elements communicated with air trapped in the IGU interior to remove the entrapped airborne water vapor and thus preclude its condensation within the unit. Thus after the water vapor entrapped in the IGU was removed internal condensation only occurred when the unit failed.

In some cases the sheet metal was roll formed into a continuous tube, with desiccant inserted, and fed to cutting stations where "V" shaped notches were cut in the tube at corner locations. The tube was then cut to length and bent into an appropriate frame shape. The continuous spacer frame, with an appropriate sealant in place, was then assembled in an IGU.

Alternatively, individual roll formed spacer frame tubes were cut to length and "corner keys" were inserted between adjacent frame element ends to form the corners. In some constructions the corner keys were foldable so that the sealant could be extruded onto the frame sides as the frame moved linearly past a sealant extrusion station. The frame was then folded to a rectangular configuration with the sealant in place on the opposite sides. The spacer assembly thus formed was placed between glass lites and the IGU assembly completed.

IGUs have failed because atmospheric water vapor infiltrated the sealant barrier. Infiltration tended to occur at the frame corners because the opposite frame sides were at least partly discontinuous there. For example, frames where the corners were formed by cutting "V" shaped notches at corner locations in a single long tube. The notches enabled bending the tube to form mitered corner joints; but afterwards potential infiltration paths extended along the corner parting lines substantially across the opposite frame faces at each corner.

Likewise in IGUs employing corner keys, potential infiltration paths were formed by the junctures of the keys and frame elements. Furthermore, when such frames were folded into their final forms with sealant applied, the amount of sealant at the frame corners tended to be less than the amount deposited along the frame sides. Reduced sealant at the frame corners tended to cause vapor leakage paths.

In all these proposals the frame elements had to be cut to length in one way or another and, in the case of frames connected together by corner keys, the keys were installed before applying the sealant. These were all manual operations which limited production rates. Accordingly, fabricating IGUs from these frames entailed generating appreciable amounts of scrap and performing inefficient manual operations.

In spacer frame constructions where the roll forming occurred immediately before the spacer assembly was completed, sawing, desiccant filling, and frame element end plugging operations had to be performed by hand which greatly slowed production of units.

U.S. Pat. No. 5,361,476 to Leopold discloses a method and apparatus for making IGUs wherein a thin flat strip of sheet material is continuously formed into a channel shaped spacer frame having corner structures and end structures, the spacer thus formed is cut off, sealant and desiccant are applied, and the assemblage is bent to form a spacer assembly. U.S. Pat. No. 5,361,476 is incorporated herein by reference in its entirety.

U.S. Pat. No. 7,448,246 illustrates a mechanical crimper having crimping fingers, imposing folds along the spacer frame by mechanically connecting slides, cylinders, and the crimping fingers to the spacer frame while the spacer frame is being advanced. Stated another way, the crimping station included a number of slides and cylinders in addition to the crimping fingers that moved with the product by mechanically coupling the cylinders and fingers to the spacer while the material forming the spacer is advanced through the station. When the required number of crimps were complete, an additional cylinder was released from the spacer, allowing the crimper fingers and cylinders to be pulled back to a starting position by a mechanical spring. U.S. Pat. No. 7,448,246 is incorporated herein by reference in its entirety.

SUMMARY

One example embodiment of the present disclosure includes an apparatus for forming a spacer frame assembly used in the construction of insulating glass unit windows. The apparatus comprises a head arrangement having a body with first and second ends, the first end for coupling to a cylinder that advances and retracts the head arrangement in a reciprocating motion during operation. The apparatus further comprises an annular die support having a second annular wedge-shaped ridge for coupling to an annular wedge-shaped ridge of the second end of the head arrangement. Collectively the wedge-shaped ridge and the second annular wedge-shaped ridge form a contact region comprising an annular torus surface. The die support is for supporting at least one die for back and forth movement in response to movement of said cylinder. The die support has the at least one die for engaging the spacer frame during operation. The apparatus further comprises a collar having a torus-shaped recess corresponding with the torus surface to nest and couple the body to the die support.

Another example embodiment of the present disclosure includes a method of using an apparatus for forming a spacer frame assembly used in the construction of insulating glass unit windows. The method includes providing a head arrangement having a body with first and second ends. Wherein the head arrangement advances and retracts in a reciprocating motion during operation, and wherein said second end of the head arrangement comprises an annular wedge-shaped ridge. The method additionally includes providing an annular die support having a second annular wedge-shaped ridge and at least one die for interacting with the spacer frame assembly and coupling the annular wedge-shaped ridge to the second annular wedge-shaped ridge to form a contact region comprising an annular torus surface. The method further includes clamping the annular wedge-shaped ridge and second annular wedge-shaped ridge together.

One example embodiment of the present disclosure includes an apparatus for forming an aperture in a spacer frame assembly used in the construction of insulating glass unit windows. The apparatus comprises a head arrangement having a body with first and second ends, the first end for coupling to a cylinder that advances and retracts the head arrangement in a reciprocating motion during operation. The apparatus further comprises an annular die support having a second annular wedge-shaped ridge for coupling to an annular wedge-shaped ridge of the second end of the head arrangement. Collectively the wedge-shaped ridge and the second annular wedge-shaped ridge form a contact region comprising an annular torus surface. The die support is for supporting at least one die for back and forth movement in response to movement of said cylinder. The die support has the at least one die for engaging the spacer frame during operation. The apparatus further including a collar having a first portion and a second portion coupled together by one or more fasteners wherein the fasteners generate tension to maintain a constant position of the die support relative to the collar and the second end. The collar has an annular torus-shaped recess corresponding with a shape and a profile of the annular torus surface to nest and couple said body to said die support. Wherein the annular torus shaped recess comprises a first annular torus recessed surface of the first portion of the collar and a second annular torus recessed surface of the second portion of the collar. The first and second annular torus recessed surfaces mirror each other.

BRIEF DESCRIPTION OF THE DRAWINGS

The foregoing and other features and advantages of the present disclosure will become apparent to one skilled in the art to which the present disclosure relates upon consideration of the following description of the invention with reference to the accompanying drawings, wherein like reference numerals, unless otherwise described refer to like parts throughout the drawings and in which.

Figure 1:
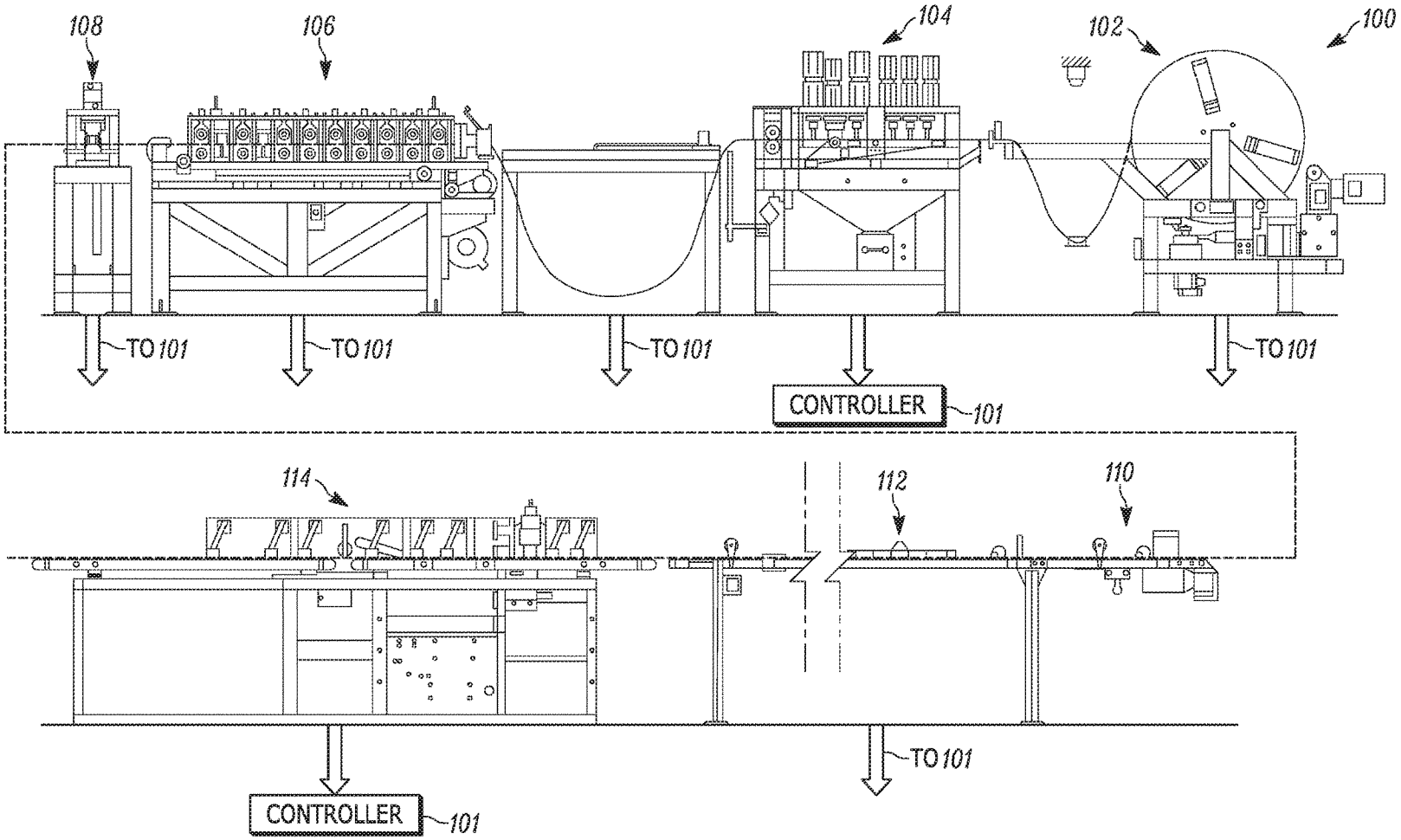
FIG. 1 is a schematic depiction of a production line for use with the present disclosure in the fabrication of spacer frames.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Referring now to the figures wherein like numbered features shown therein refer to like elements throughout unless otherwise noted. The present disclosure relates generally to insulating glass units and more particularly to a method and apparatus for fabricating a spacer frame for use in making a window.

The drawing Figures and following specification disclose a method and apparatus for producing elongated window components 8 (see FIG. 2) used in insulating glass units 10 with a production line 100 as illustrated in FIG. 1. Examples of elongated window components 8 include spacer frame assemblies 12 and muntin bars 130 that form parts of insulating glass units (IGU) 10. The IGU elongated window components 8 are formed in one example embodiment from a production line 100 which forms sheet metal ribbon-like stock material into muntin bars 130 and/or spacers carrying sealant and desiccant for completing the construction of insulating glass units.

Figure 2:
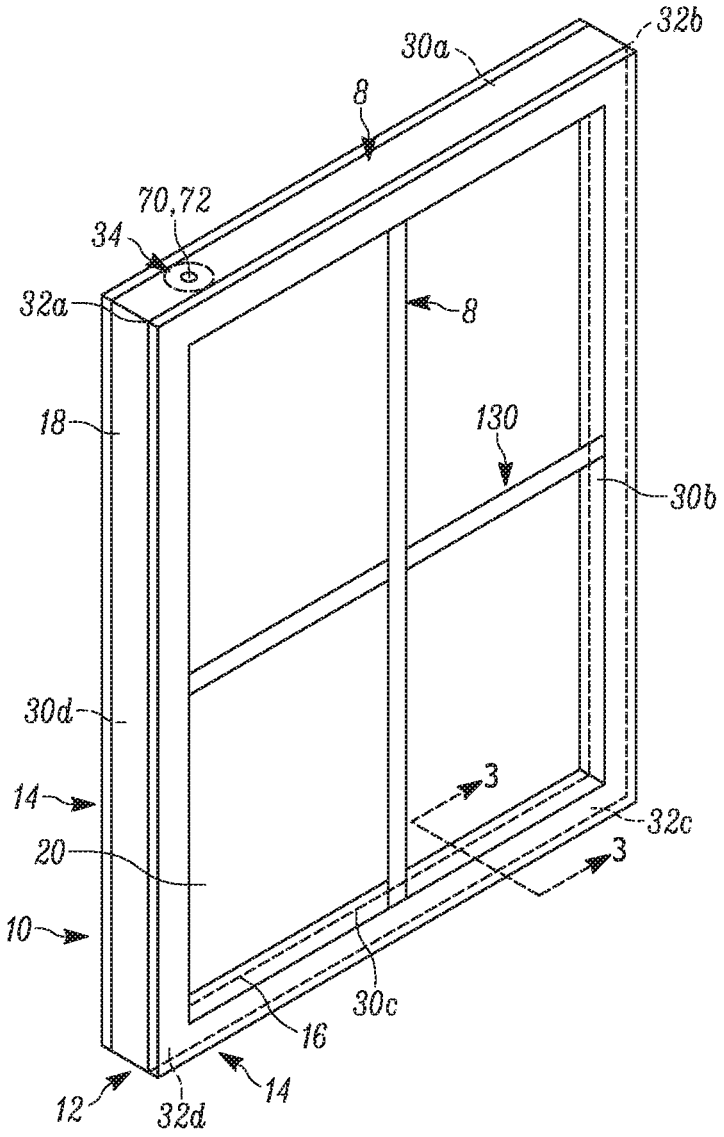
FIG. 2 is a perspective view of an insulating glass unit including glass lites.
Figure 2A:
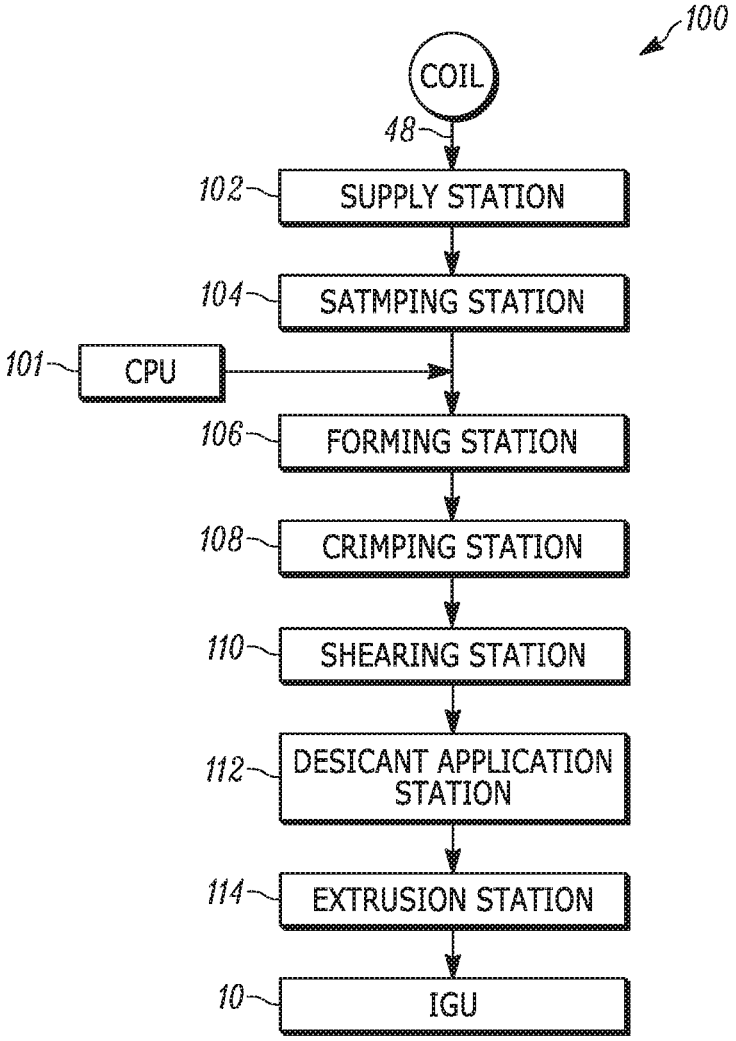
FIG. 2A is a schematic block diagram of a production line for manufacturing a spacer frame in accordance with one example embodiment of the present disclosure.

Illustrated in FIG. 2A is a schematic block diagram of a production line 100, as illustrated in FIG. 1, for manufacturing a conventional spacer frame and insulating glass unit as further described in U.S. Pat. No. 7,610,681, which is incorporated herein by reference. In the illustrated example embodiments of FIGS. 1 and 2A, the production line 100 may be used to fabricate the insulating glass units 10 and spacer frame assemblies 12 of the present disclosure. A stock strip 48 of material is fed endwise from a coil from a supply station 102 into the production line 100 and substantially completed elongated window components 8 emerge from the other end of the line.

The production line 100 comprises the stock supply station 102, a stamping station 104 where various notches, hole indentations, or lines and/or zones of weaknesses, and tab profiles are punched into the flat stock strip 48, a forming station 106 where the flat stock strip is roll formed to make a u-shaped channel, a crimping station 108 where corners and swaging is performed on the u-shaped channel, a shearing 110 station where the individual spacer frames are separated from the flat stock and cut to length, a desiccant application station 112 where desiccant is applied between glass lites and the interior region formed by the lites and spacer frame assembly 12, and an extrusion station 114 where sealant is applied to the yet to be folded frame.

Figure 3:
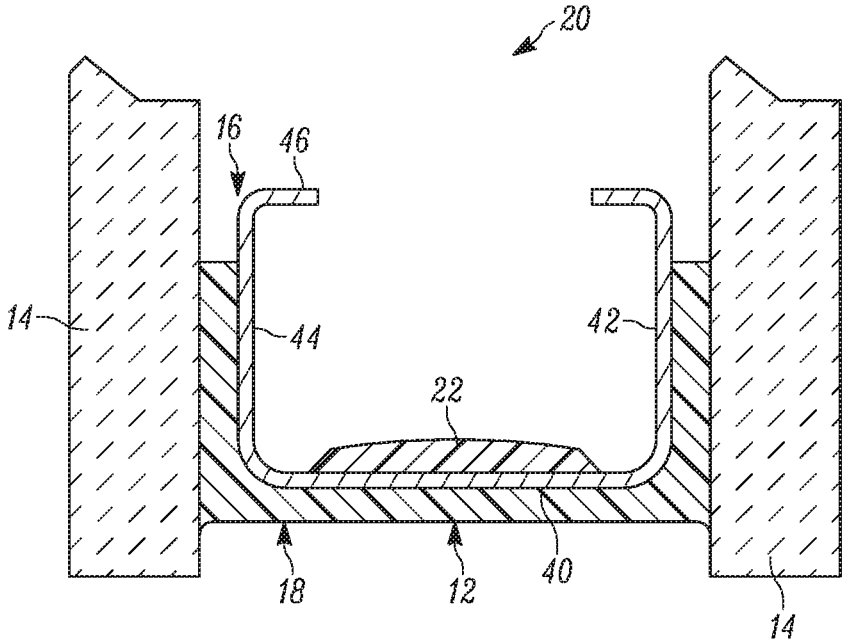
FIG. 3 is a cross sectional view seen approximately from the plane indicated by the line 3-3 of FIG. 2.
Figure 4A:
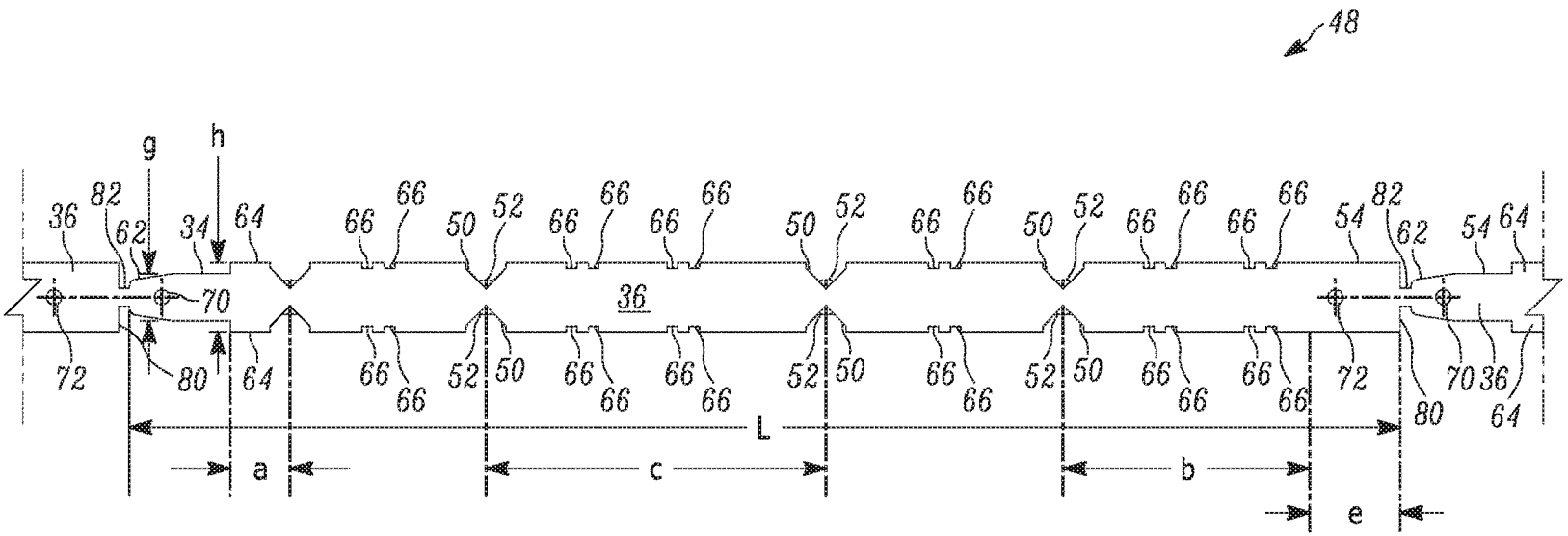
FIG. 4A is a plan view of flat stock after a punching operation that will be formed into one or more spacer frame assemblies before the flat stock is roll-formed or has sealant applied.
Figure 4B:
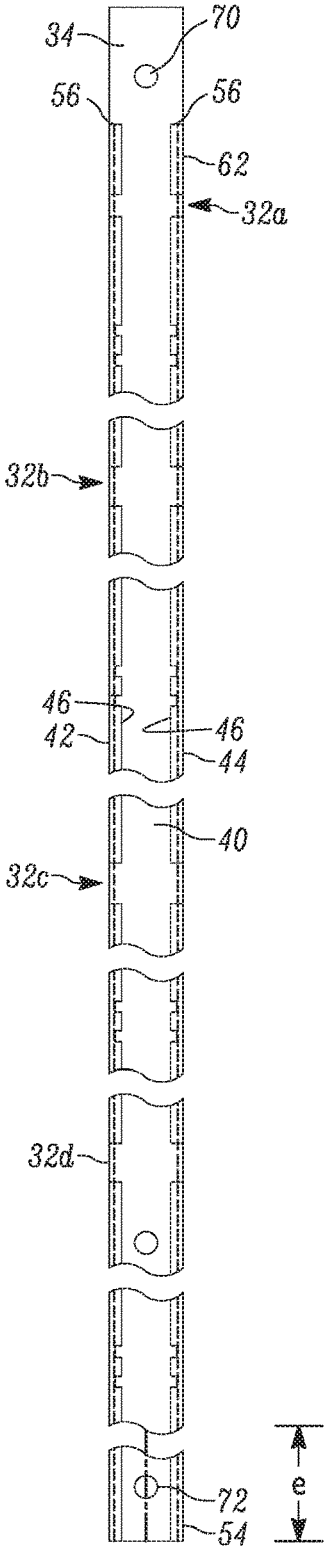
FIG. 4B is a plan view of the spacer frame assembly of FIG. 4A after a roll-forming operation in an unfolded condition.
Figure 5:
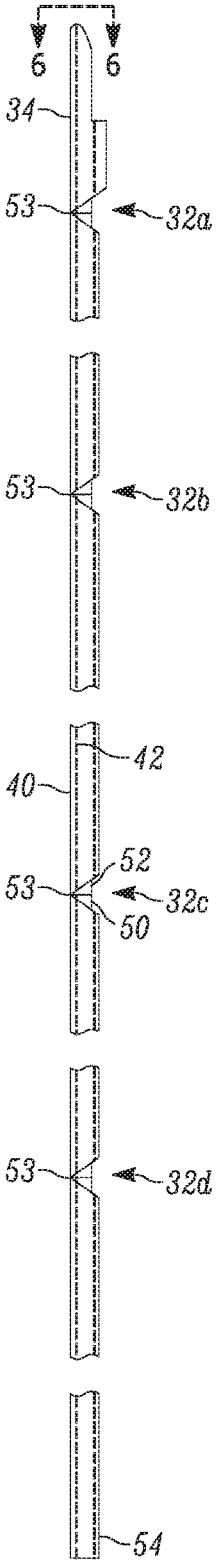
FIG. 5 is side elevation view of the spacer frame assembly of FIG. 4B.

With reference to the operation of the stamping station 104, dies on opposite side of the strip 48 are driven into contact with the metal strip by an air actuated drive cylinder enclosed within the stamping station. In the illustrated embodiment, two air actuated cylinders drive a die support downward, moving spaced apart dies into engagement with the strip 48 to form a punch strip 36 as illustrated in FIG. 4A, which is backed by an anvil in the region of contact with the dies. Due to the need to fabricate spacer frame assemblies 12 of different width between side walls, 42, 44, as illustrated in FIG. 3, the dies are movable with respect to each other so that the region of contact between die and strip 48 is controlled. Similarly, when a nose portion or tab 34, as illustrated in FIGS. 4A, 4B and 5, of the spacer frame assembly 12 is formed, separate dies on opposite sides of the strip 48 engage the punch strip 36 at controlled locations to form a nose profile. When the width of the spacer frame between the side walls 42, 44 changes the relative position of these two dies is also adjusted. In the exemplary embodiment, stamping of the nose or tab 34 occurs at a separate time from stamping of the corners at notches 50. Stated another way, four corners 32*a*-32*d*, as illustrated in FIG. 2, are formed by a first die set controlled by a controller 101 that also controls each station of the production line 100 and the nose or tab 34 is formed at another time by a separated air cylinder drive that moves a separate die pair into contact with the punch strip 36. Coordination of these separate actuations is controlled by movement of the punch strip 36 through the stamping station 104 to appropriate positions for forming the corners 32 and the nose portion 34 of the spacer frame 12.

An insulating glass unit 10 illustrated in FIG. 2 is constructed using the method and apparatus further described in FIGS. 1 and 2A as discussed above and in U.S. Pat. Nos. 8,720,026 and 7,448,246, which are both incorporated herein by reference. In FIGS. 2-6 the IGU 10 comprises the spacer frame assembly 12 sandwiched between glass sheets, or lites, 14. The spacer frame assembly 12 comprises a frame structure 16, sealant material 18 for hermetically joining the frame to the lites to form a closed space 20 within the unit 10 and a body 22 of desiccant in the space 20, as illustrated in FIG. 3. The insulating glass unit 10 is illustrated in FIG. 2 as in condition for final assembly into a window or door frame, not illustrated, for ultimate installation in a building. The unit 10 illustrated in FIG. 2 includes the muntin bars 130 that provide the appearance of individual window panes.

The assembly 12 maintains the lites 14 spaced apart from each other to produce the hermetic insulating "insulating air space" 20 between them. The frame 16 and the sealant body 18 co-act to provide a structure which maintains the lites 14 properly assembled with the space 20 sealed from atmospheric moisture over long time periods during which the unit 10 is subjected to frequent significant thermal stresses. The desiccant body 22 removes water vapor from air, or other volatiles, entrapped in the space 20 during construction of the unit 10.

The sealant body 18 both structurally adheres the lites 14 to the spacer assembly 12 and hermetically closes the space 20 against infiltration of airborne water vapor from the atmosphere surrounding the unit 10. The illustrated body or sealant 18 is formed from a number of different possible materials, including for example, butyl material, hot melt, reactive hot melt, modified polyurethane sealant, and the like, which is attached to the frame sides and outer periphery to form a U-shaped cross section.

Figure 7A:
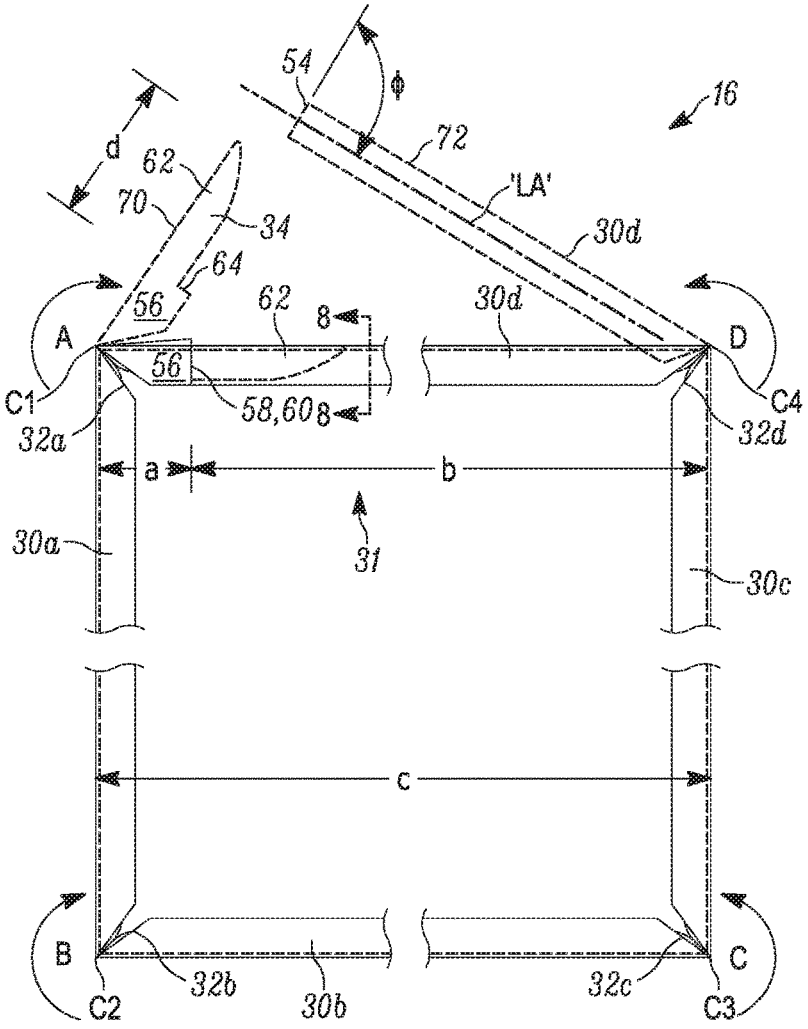
FIG. 7A is a fragmentary elevation view of a spacer frame forming part of the unit of FIG. 2 which is illustrated in a partially constructed condition.

The spacer frame structure 16 extends about the unit periphery to provide a structurally strong, stable spacer for maintaining the lites 14 aligned and spaced while minimizing heat conduction between the lites via the frame. In one example embodiment, the spacer frame structure 16 comprises a plurality of spacer frame segments, or members,

30*a*-30*d* connected to form a planar, polygonal frame shape, element juncture forming the frame corner structures 32*a*-32*d*, and connecting structure or tab 34 for joining opposite frame element ends or tail 30*d* to complete the closed frame shape (see FIG. 7A).

Each frame member 30 is elongated and has a channel shaped cross section defining a peripheral wall 40 and the first and second lateral walls 42, 44. See FIGS. 3, 4B, 5, and 6. The peripheral wall 40 extends continuously about the unit 10 except where the connecting structure or tab 34 joins the frame member end 30*d*. The lateral walls 42, 44 are integral with respective opposite peripheral wall 40 edges. The lateral walls 42, 44 extend inwardly from the peripheral wall 40 in a direction parallel to the planes of the lites 14 and the frame structure 16. The illustrated frame structure 16 of FIGS. 3, 4B, and 6 has stiffening flanges 46 formed along the inwardly projecting lateral wall 42, 44 edges. The lateral walls 42, 44 add rigidity to the spacer frame members 30 so it resists flexure and bending in a direction transverse to its longitudinal extent. The flanges 46 stiffen the walls 42, 44 so they resist bending and flexure transverse to their longitudinal extents.

The frame structure 16 is initially formed as a continuous straight channel constructed from a thin ribbon of metal or the flat stock strip 48. One example of suitable metal includes stainless steel material having a thickness of 0.006-0.010 inches. Other materials, such as galvanized, tin plated steel, or aluminum, plastic, or foam may also be used to construct the channel without departing from the spirit and scope of the present disclosure.

Illustrated in FIG. 4A is a continuous metal ribbon or flat stock strip 48 after it passed through the stamping station 104 and punched by a number of dies to form the notches 50 and weakening zones 52 for corner folds 32, clip notches 66 (used in securing the muntin bars 130), the nose portion or tab 34, a nose 62, apertures 70, 72, and end cut 80. A punch strip 36 of the flat stock strip 48 forms a single spacer frame assembly 16 as illustrated in repeating sections by dimension "L" from the continuous strip. The punch strip 36 is eventually sheared to make the spacer frame assembly 16 at end 80 and the nose 62, leaving scrap piece 82. Alternatively, the punching or shearing operation is a single hit operation in which the width of the shear equals that of scrap piece 82, leaving no scrap or need for a double hit operation. Further discussion relating to the shearing or punching operation is discussed in U.S. Pat. No. 8,720,026, which is incorporated herein by reference.

The nose portion or tab 34 and stops 64 are formed by stamping dies at the stamping station 104 as described above. Shown by dimension "g" in one example embodiment is the nose portion or tab 34 width, which is smaller than the width of the stop 64 illustrated by dimension "h" in FIG. 4A. In one example embodiment, the width of the nose portion or tab 34 shown by dimension "a" is one inch 1.00" and the width of the stops 64 shown by dimension "b" is one and three sixteenths of one inch 1.187". Thus, the difference between the width of the nose 62 and stops 64 of the above example embodiment is approximately ninety-three thousands 0.093" of one inch from the outside edge of the strip. The nose and stops of the example embodiment are further discussed in U.S. Pat. No. 9,428,953, which is incorporated herein by reference.

The clip notches 66 are formed to support flexible clips that reside within the spacer frame structure 16 and IGU 10 once assembled. The flexible clips are used to support, for example, muntin bars 130 as further discussed in U.S. Pat. No. 5,678,377, which is incorporated herein by reference. The notches 50 and the weakening zones 52 are punched and crimped into the continuous strip 48, allowing for the formation of the corner structures 32. Further discussion of the punching and crimping operations is discussed in U.S. Pat. No. 7,448,246, which is incorporated by reference.

Figure 6:
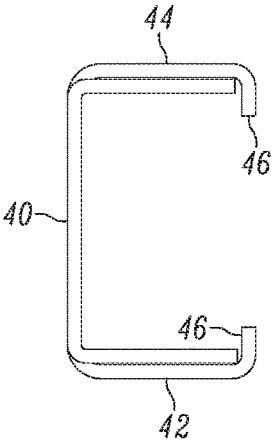
FIG. 6 is an enlarged elevation view seen approximately from the plane indicated by the line 6-6 of FIG. 5.

Before the punch strip 36 is sheared from the continuous strip 48, it is roll formed to the configuration illustrated in FIGS. 4B, 5 and 6, creating peripheral wall 40, lateral walls 42, 44, and stiffening flanges 46. Further discussion as to the roll forming operation is discussed in U.S. Pat. No. 8,904,611, which is incorporated herein by reference.

The corner structures 32 are formed to facilitate bending the frame channel to the final, polygonal frame configuration in the unit 10 while assuring an effective vapor seal at the frame corners, as seen in FIGS. 2 and 7A. The sealant body 18 is applied and adhered to the channel before the corners are bent. The corner structures 32 initially comprise the notches 50 and the weakening zones 52 formed in the walls 42, 44 at frame corner locations. See FIGS. 3-5. The notches 50 extend into the walls 42, 44 from the respective lateral wall edges. The lateral walls 42, 44 extend continuously along the frame structure 16 from one end to the other. The walls 42, 44 are weakened at the corner locations because the notches 50 reduce the amount of lateral wall material and eliminate the stiffening flanges 46 and because the walls are stamped to form a line of weakness 53 (see FIG. 5) to weaken the walls at the corners 32 and facilitate inward flexing as the corners are formed.

The nose portion or tab 34 secures an opposite frame end 54 or the frame member end 30*d* together with a first frame end 56 when the spacer frame assembly 12 has been bent to its final configuration. That is, rotating the linear spacer frame assembly 12 segments or members 30 (from the linear configuration of FIGS. 4B and 5) in the direction of arrows A, B, C, and D as illustrated in FIG. 7A and particularly, inserting the nose 62 of the nose portion or tab 34 into the channel formed at the opposite frame end 54 of frame member end 30*d* with concomitant rotation of the segments (arrows A-D). This concomitant rotation continues until the channel of the frame member end 30*d* at the opposite frame end 54 engages positive stops 64 in the nose portion or tab 34. Wherein, the first frame end 56 forms a telescopic union 58 and lateral connection 60 to make a compound lateral leg 31.

The telescopic union 58 and lateral connection 60 are along the lateral leg 31 spaced from the corner structures 32, which in the illustrated example embodiment of FIG. 7A wherein, the completed frame corner is C1. When assembled, the telescopic union 58 maintains the frame structure 16 in its final polygonal configuration prior to assembly of the insulating glass unit 10. The compound lateral leg 31 has a length of dimension "a" (first frame end 56 from the corner C1 to the end of the stop end 64) plus dimension "b" (the frame member end 30*d*), which equals the length of dimension "c" (see FIG. 7A), the length of a second and opposite side segment 30*b*. The dimension "b" in the illustrated example embodiment, is the length of the frame member end 30*d* and dimension "a" is the length of the nose portion or tab 34 less the length of the nose 62 (dimension "d") that is inserted into the channel formed in the frame member end 30*d*.

Figure 7B:
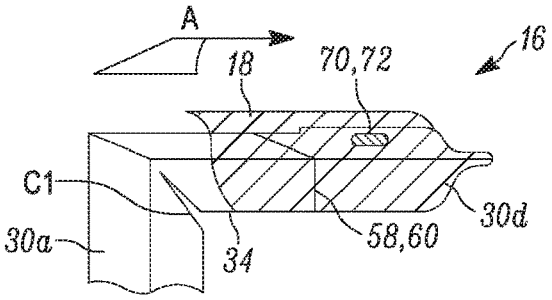
FIG. 7B is a partial perspective view of a spacer frame of FIG. 7A.

In the illustrated example embodiment of FIGS. 7A-7B, the nose portion or tab 34 further comprises a first aperture 70 and corresponding second aperture 72 in the frame member end 30*d* for a fastener arrangement (not shown) for both connecting the opposite frame end 54 with the first frame end 56 and providing a temporary vent for the evacuation of air or insertion of gas into the space 20 while the unit 10 is being fabricated. The apertures 70 and 72 are automatically aligned because of the configurable dimensions "a" and "b" that when summed equal "c" (see FIG. 7A) when the frame ends 54, 56 are properly telescoped together and the opposite frame end 54 engages stops 64. The stops 64 reassure concentric alignment of the apertures 70, 72.

Figure 8A:
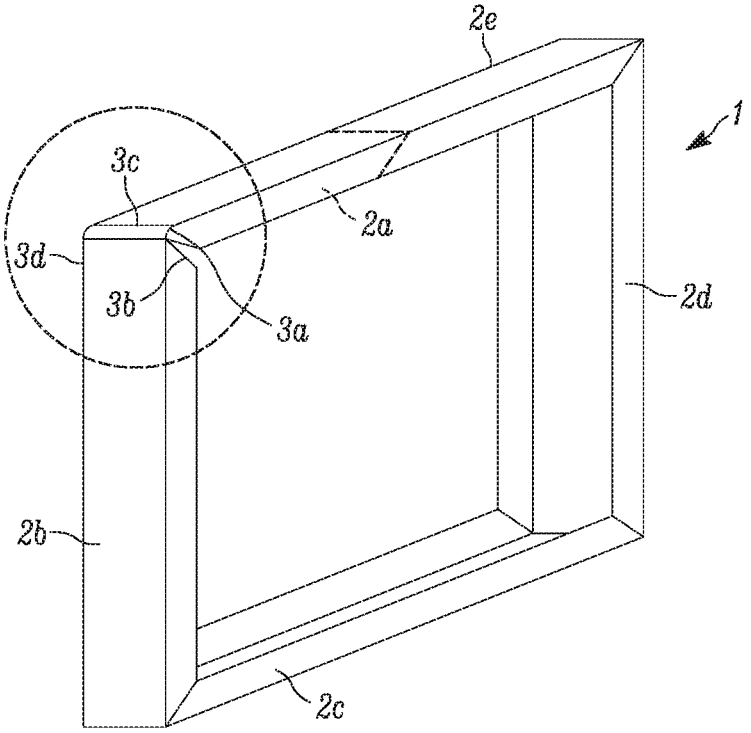
(PRIOR ART) FIG. 8A
FIG. 8A is a perspective view of a spacer frame.
Figure 8B:
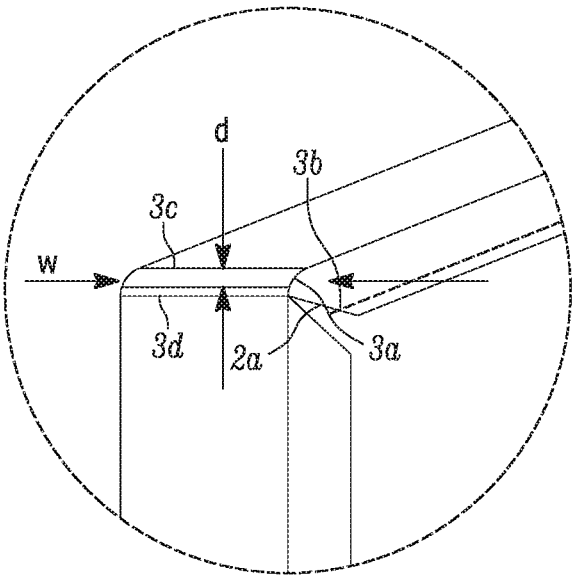
(PRIOR ART) FIG. 8B
FIG. 8B is a partial perspective view of a spacer frame of FIG. 8A.

The stops 64 further reassure a repeatable length of the telescopic union 58 of the lateral connection 60. This advantageously reassures that all four corner structures 32*a*-32*d* are identical in spacing, size, angle orientation, and construction, thus reducing the potential for failure. In conventional spacer frames 1 of the prior art, as illustrated in FIGS. 8A and 8B without the union 58 and lateral connection 60, over and under extension of the corners can occur. The conventional spacer frame 1 includes five different legs 2*a*, 2*b*, 2*c*, 2*d*, and 2*e*. Leg 2*a* is a tab that in the conventional spacer frame 1 when assembled is inserted into a last connecting leg 2*e*. The last connecting leg 2*e* includes a chamfered end 3, such that end sides 3*a* and 3*c* of the last connecting leg 2*e* bottom out on corresponding ends 3*b* and 3*d* to form a corner junction. This over and under extension in convention frames 1 is in part because of differences in tolerances because the last connecting leg 2*e* fails to bottom out, leaving gaps d and w.

The configurable dimensions "a" and "b" (see FIG. 7A) further provide assurance that the corner segments 32*a*-32*d* are all equally spaced and orthogonal, reducing any spacing or gaps on the lateral walls 42, 44, peripheral wall 40 in the space from corner union point 58 or lateral connection 60, thus reducing the opportunity for failure.

For the apertures 70, 72, alignment is important and in conventional spacer frames typically requires an awl for manual alignment. The apertures provide a gas passage before a fastener, such as a rivet (not shown) is installed. The fastener once installed in the auto-aligned apertures 70, 72 is covered with sealant material 18 so that the seal provided by each fastener is augmented by the sealant material as illustrated in the partial perspective view of FIG. 7B. The fasteners in addition to sealing further assist in holding tab 34 in connection with frame member end 30*d*.

Figure 9:
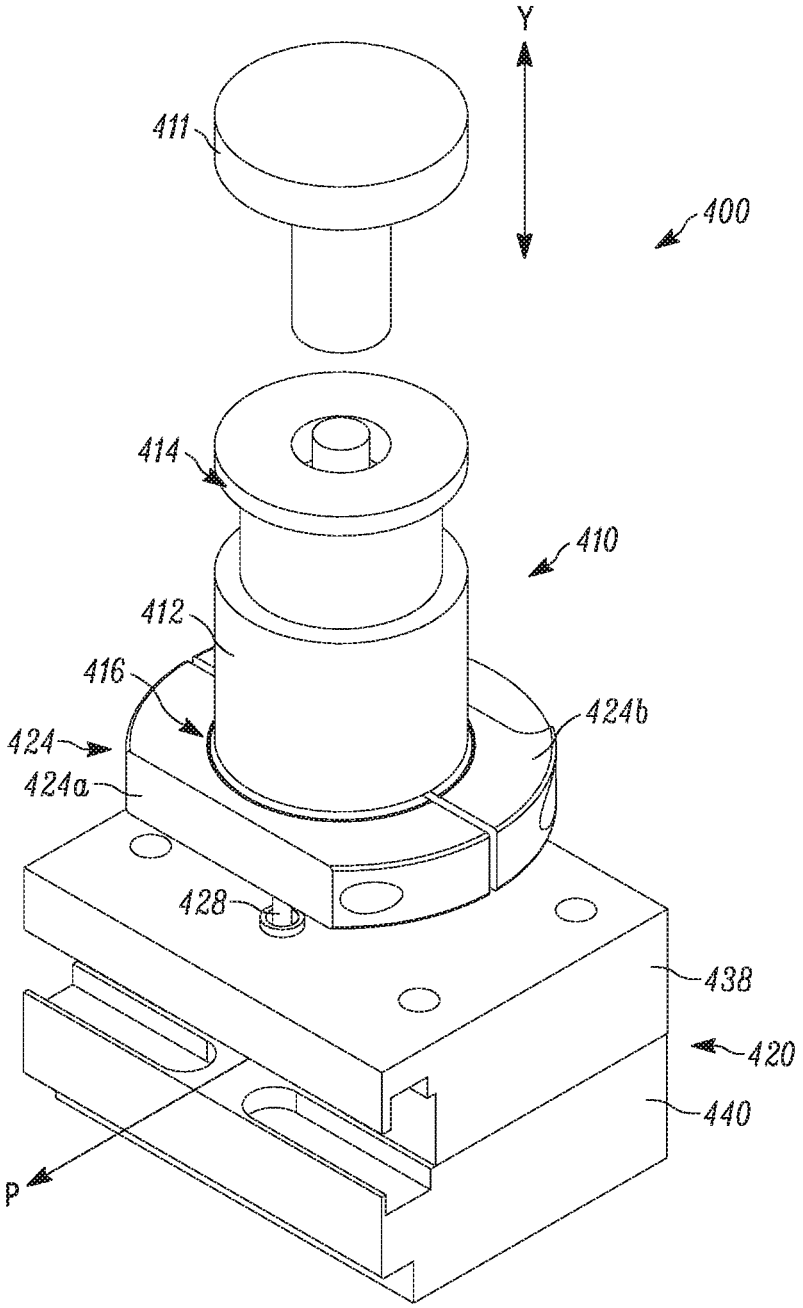
FIG. 9 is a top front perspective view of a punch assembly constructed in accordance with one embodiment of the present disclosure.
Figure 10:
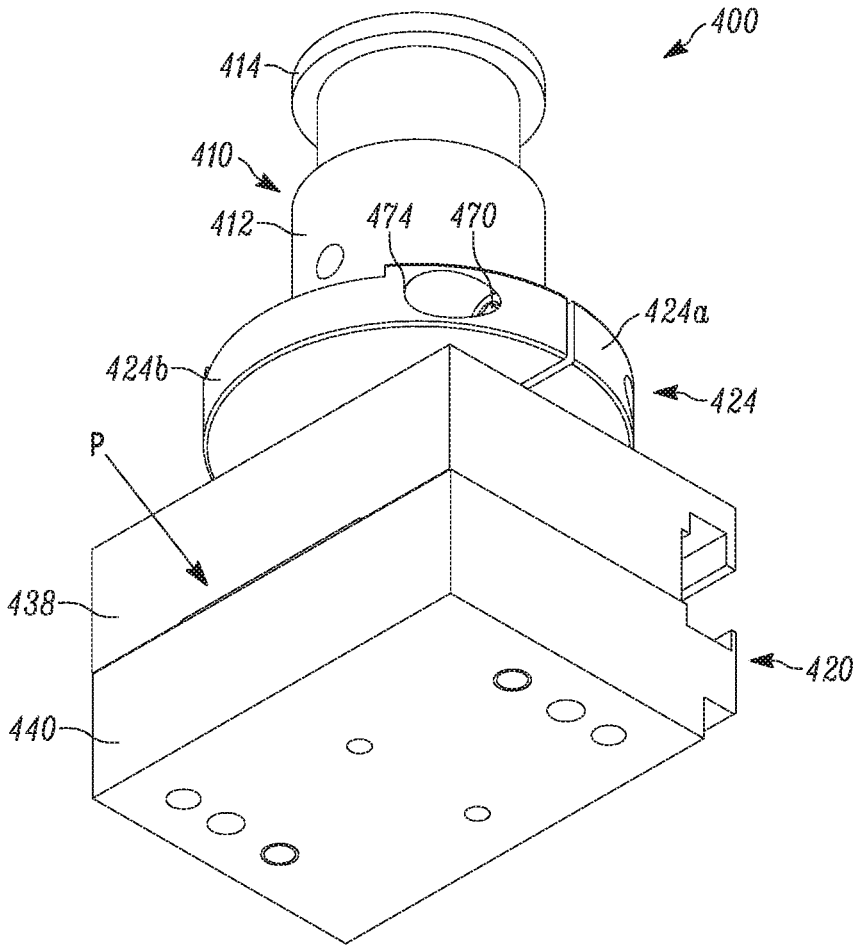
FIG. 10 is a bottom rear perspective view of a punch assembly constructed in accordance with one embodiment of the present disclosure.
Figure 11:
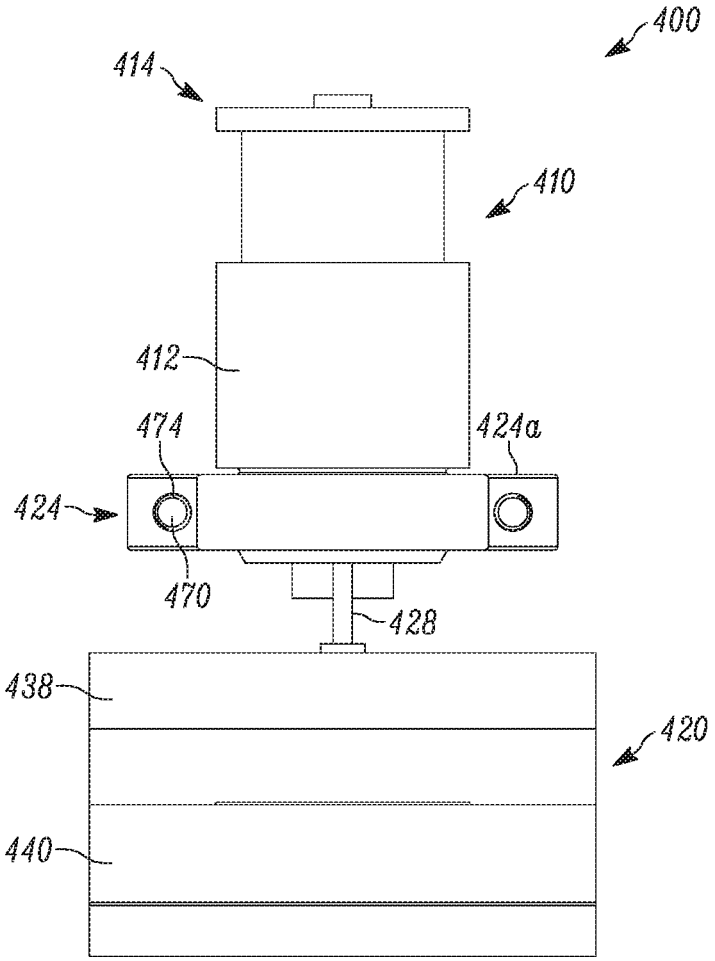
FIG. 11 is a front elevation view of a punch assembly constructed in accordance with one embodiment of the present disclosure.
Figure 12:
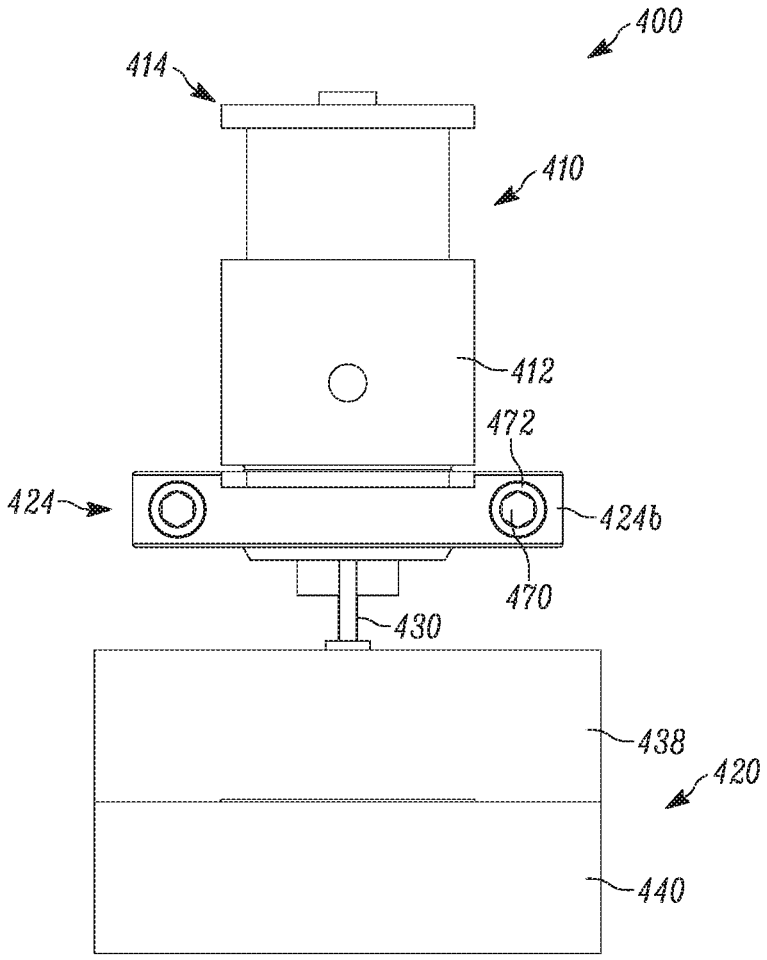
FIG. 12 is a rear elevation view of a punch assembly constructed in accordance with one embodiment of the present disclosure.
Figure 13:
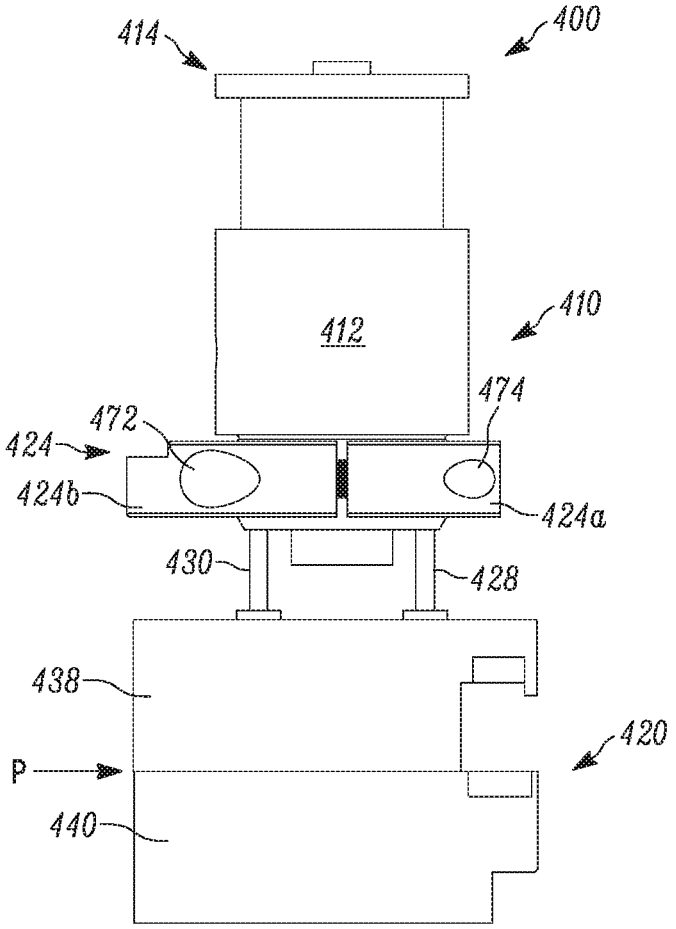
FIG. 13 is a left elevation view of a punch assembly constructed in accordance with one embodiment of the present disclosure.
Figure 14:
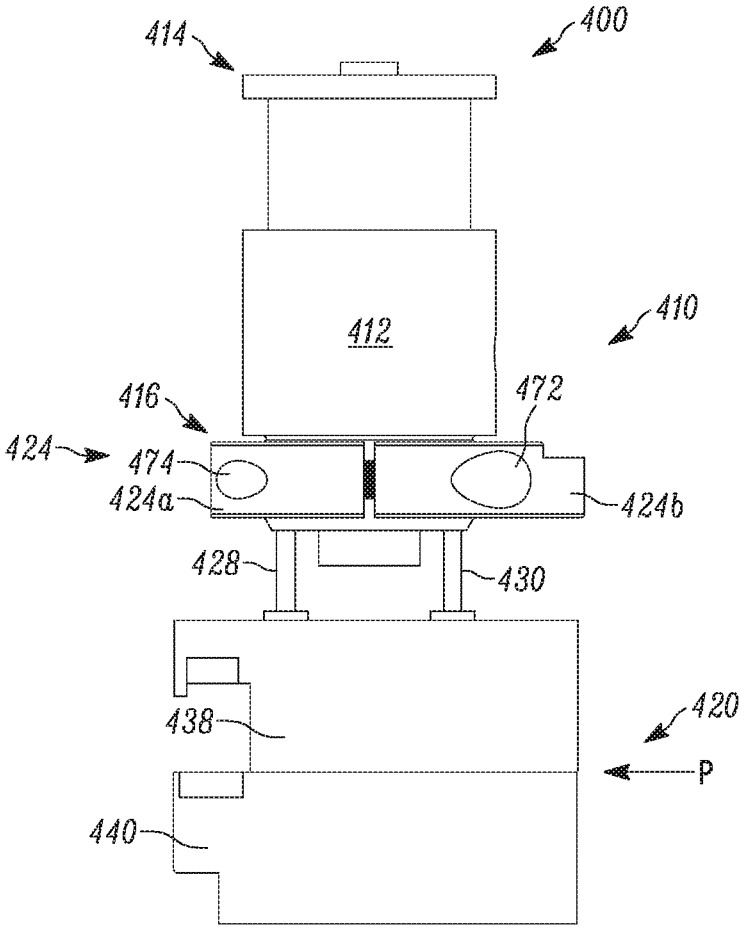
FIG. 14 is a right elevation view of a punch assembly constructed in accordance with one embodiment of the present disclosure.
Figure 15:
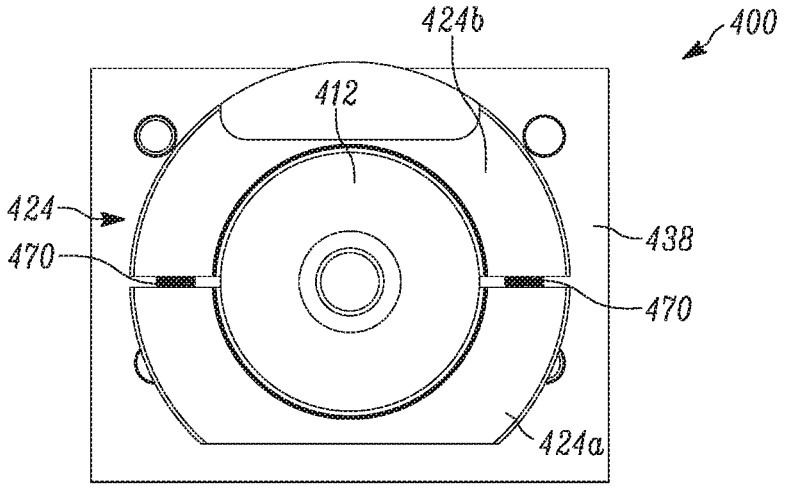
FIG. 15 is a top plan view of a punch assembly constructed in accordance with one embodiment of the present disclosure.
Figure 16:
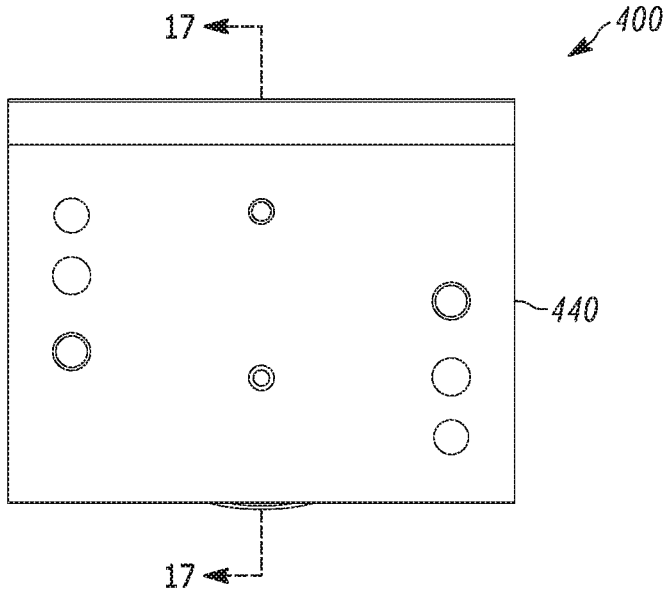
FIG. 16 is a bottom plan view of a punch assembly constructed in accordance with one embodiment of the present disclosure.
Figure 17:
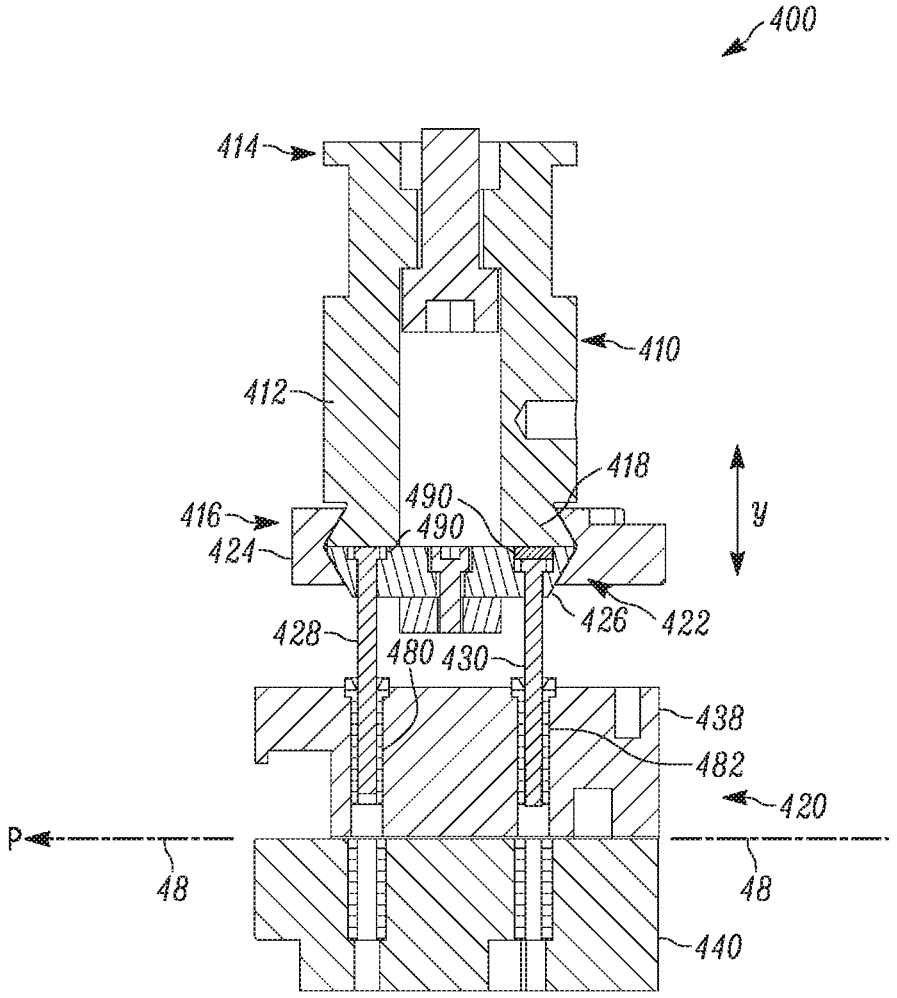
FIG. 17 is a front elevation view of a cross section as seen from the plane indicated by the line 17-17 of FIG. 16.

The apertures 70, 72 are formed by the punching station 104 into the stock strip 48 by a punch assembly 400 illustrated in FIGS. 9-22. The punch assembly 400 comprises head and base arrangements 410, 420, respectively, as illustrated in the section view of FIG. 17 about section lines 17-17 shown in FIG. 16. The head arrangement 410 is coupled to a cylinder 411 (see FIG. 9) that advances and retracts the head in the direction of the arrow Y.

Figure 18:
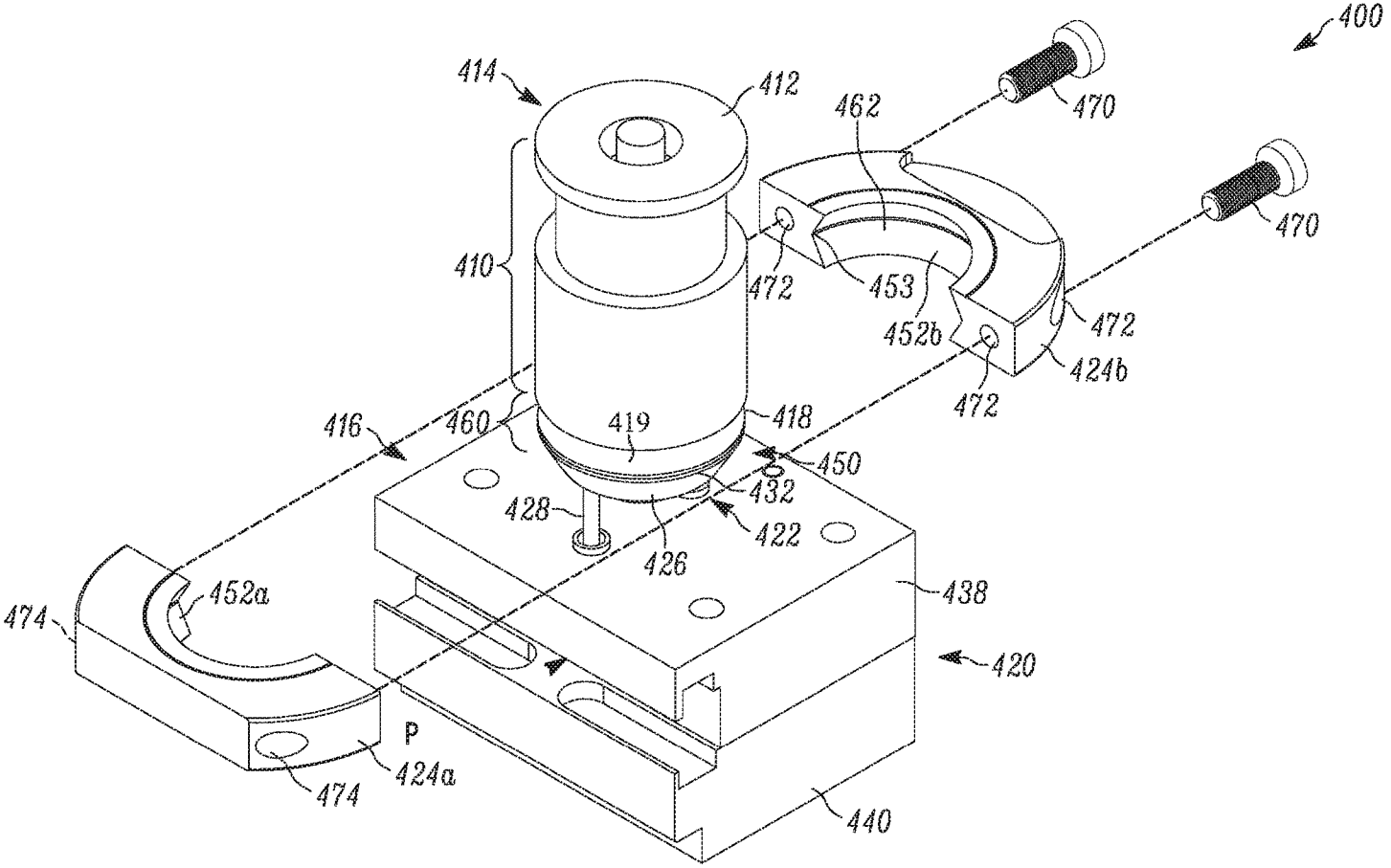
FIG. 18 is a partially exploded front perspective view of a punch assembly comprising a collar constructed in accordance with one embodiment of the present disclosure.
Figure 19:
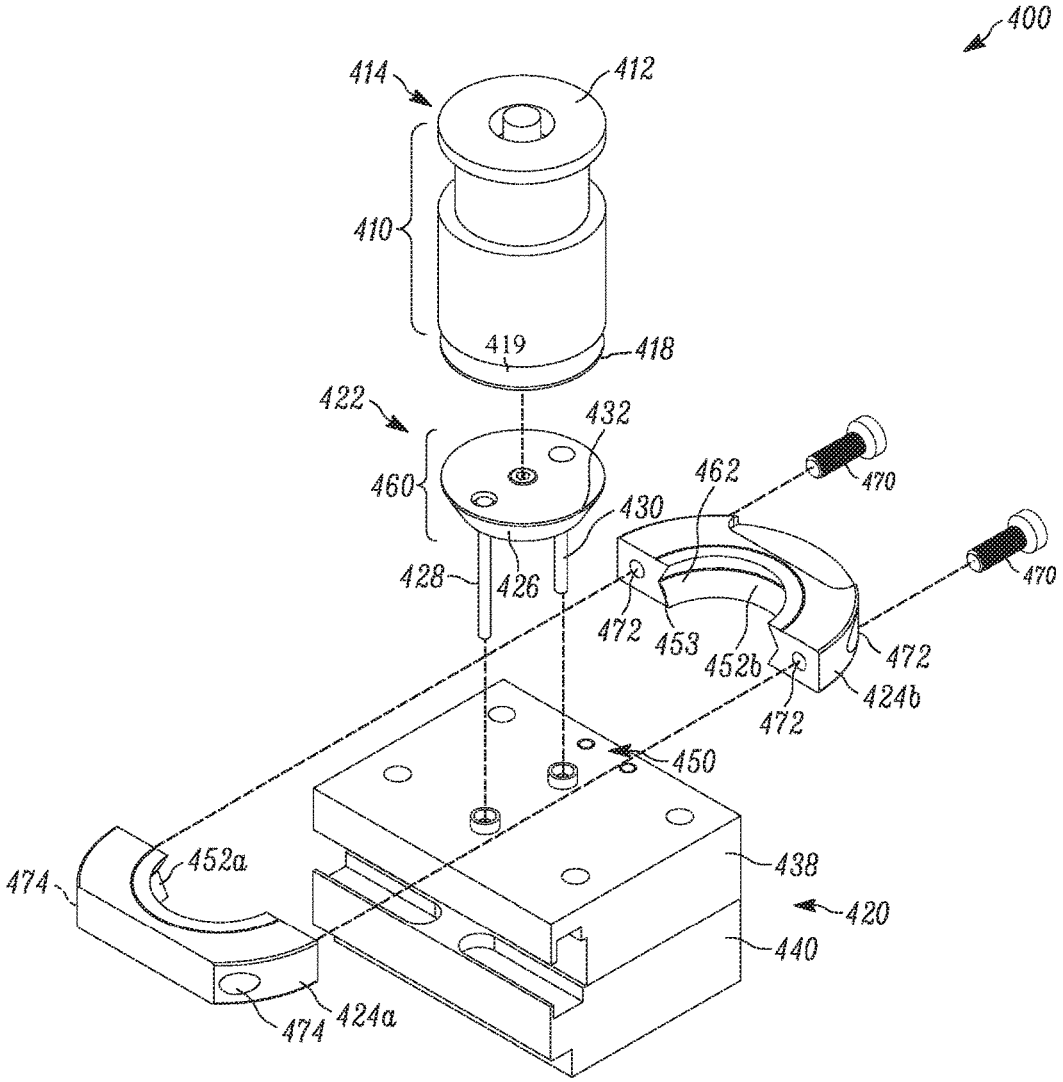
FIG. 19 is an exploded view of FIG. 18 in accordance with one embodiment of the present disclosure.

As in the illustrated example embodiment, of FIG. 18, the head arrangement 410 includes a main body 412 that comprises a first end 414 and a second end 416. The second end 416 of the main body 412 includes an annular wedge-shaped ridge 418 that bounds a generally planar, downwardly facing end face 419. In the illustrated example embodiment, the annular wedge-shaped ridge 418 has a region of maximum diameter of approximately 2.44 inches at the region of the end face 419 and necks down to form a wedge shaped notch in the main body 412. This reduction in diameter from the annular wedge-shaped ridge 418 to the main body 412 occurs uniformly to reach a diameter of 1.93 inches. It would be appreciated by one of ordinary skill in the art that the respective diameters of the annular wedge shaped ridge 418 described above may comprise an unlimited range of measurements (e.g., the diameters can be scaled up or down, or alternate ratios of the respective diameters can be implemented). Coupled to the head arrangement 410 by a split-collar 424 is a die assembly 422, comprising an annular die support 426 comprising a second annular wedge-shaped ridge 432, and punch dies 428 and 430, as illustrated in FIGS. 18-22. The punch dies 428 and 430 penetrate the strip 48 to form apertures 70, 72 as the strip 48 passes through upper and lower sections 438 and 440, respectively of the base arrangement 420 along a path of travel "P" (see FIG. 17). In one example embodiment, a spacing between dies 428, 430 allows the openings 70, 72 in two successive spacer frames to be made simultaneously with one drive cylinder actuation. It should be appreciated by those skilled in the art that additional spacer frame assemblies could be simultaneously processed by the addition of tooling or duplication of head arrangements 410.

The annular die support 426 includes the second annular wedge-shaped ridge 432. Collectively, the wedge-shaped ridge 418 of the body 412 and the second annular ridge 432 of the die support 426 form an annular torus 450 (see FIGS. 18 and 22) that mates to a conforming annular torus recessed surface 452 on the inside of the split collar 424. When assembled, the widest surfaces of the annular torus 450 comprising the wedge-shaped ridge 418 and the second wedge shaped ridge 432 abutting each other, form a contact region 460 that nests within the widest point 253 of recessed surface 452 of the split collar 424 when the collar's first and second collar portions, 424*a* and 424*b* are coupled together with fasteners 470.

As in the illustrated example embodiment of FIGS. 18-21, the fasteners 470 are inserted through oversized openings 472 or counter bore reducing to a drill through opening in the second portion 424*b* into tapped or threaded openings 474 in the first portion 424*a*. In an example embodiment, the fasteners 470 comprise a head at a first fastener end and a threaded portion at a second fastener end. The fasteners 470 are inserted threaded portion first through the oversized opening 472, such that the threaded portion of the second fastener end couples to the tapped or threaded opening 474 of the first portion 424*a*. The head interacts with the oversized openings or counter bore 472 to maintain the fastener 470 position relative to the second portion 424B and allow tightening of the fasteners utilizing the tapped or threaded openings 474. In the illustrated example embodiment, the fasteners 470 generate tension in the collar 424 to maintain a constant position of the die support 426 relative to the main body 412. In one example embodiment, the head of the fasteners 470 interacts with a second outer portion 454*b* of the second portion 424*b* to generate the tension. In another example embodiment, the head of the fasteners 470 interacts with a ledge located within the oversized opening 472 to generate the tension.

In the illustrated example embodiment of FIGS. 18-21, the first portion 424*a* of the collar 424 comprises a first annular torus recessed surface 452*a* and the second portion 424*b* comprises a second annular torus recessed surface 452*b*. The first and second annular torus recessed surfaces 252*a*-252*b* mirror each other. In the illustrated example embodiment, a first outer portion 454*a* of the first portion 424*a* comprises different dimensions than a second outer portion 454*b* of the second portion 424*b* (see FIG. 20).

A need exists to change the punch dies 428 and 430 from time-to-time as a result of wear, fracture, or varying the size based on different desired apertures 70, 72. Accordingly, a quick change is provided by the construction of the punch assembly 400. That is, the construction of the punch assembly 400 provides a shortened change over time found in conventional window spacer frame aperture punch assemblies.

Figure 20:
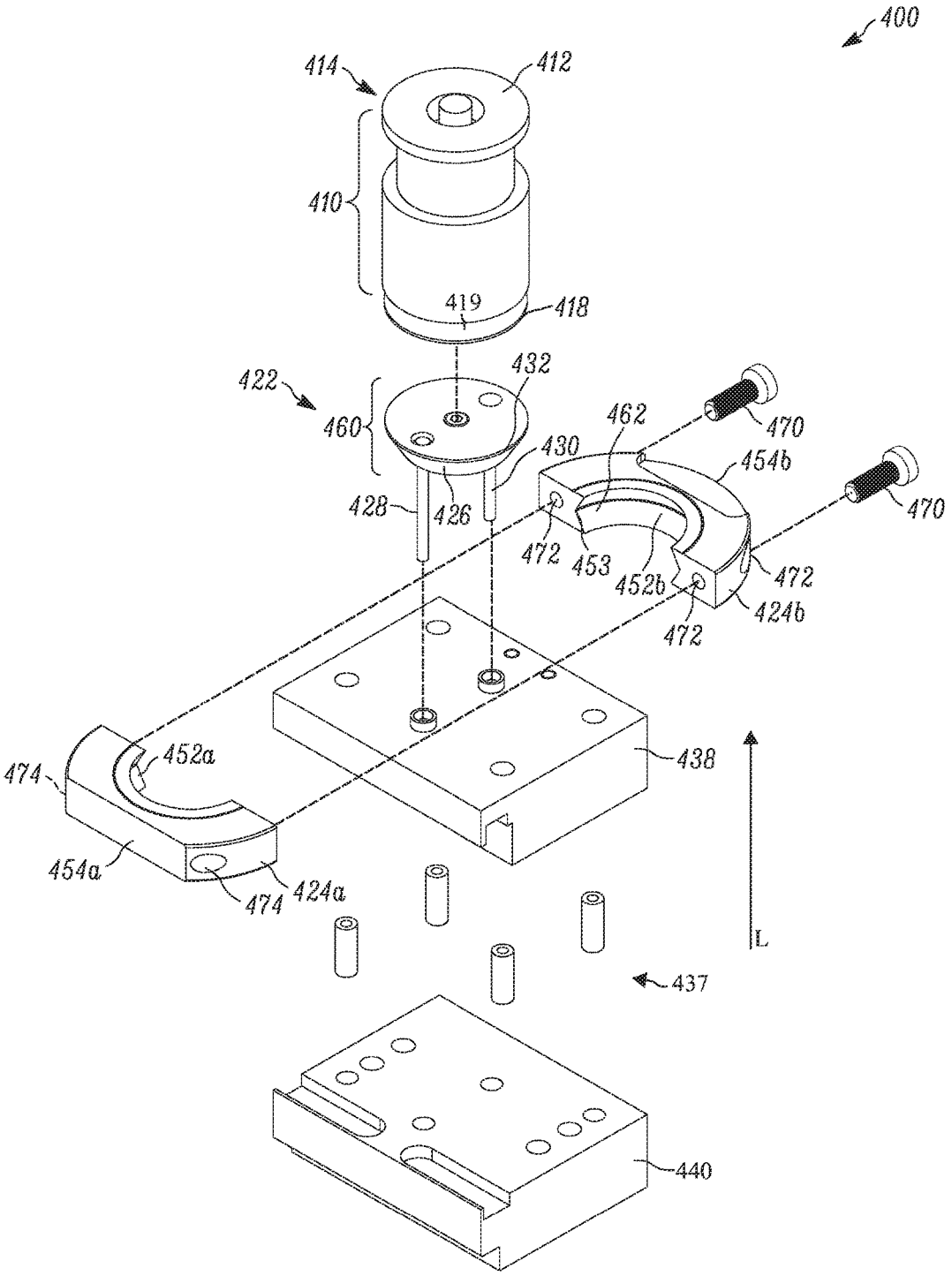
FIG. 20 is an exploded view of FIG. 18 in accordance with another embodiment of the present disclosure.
Figure 21:
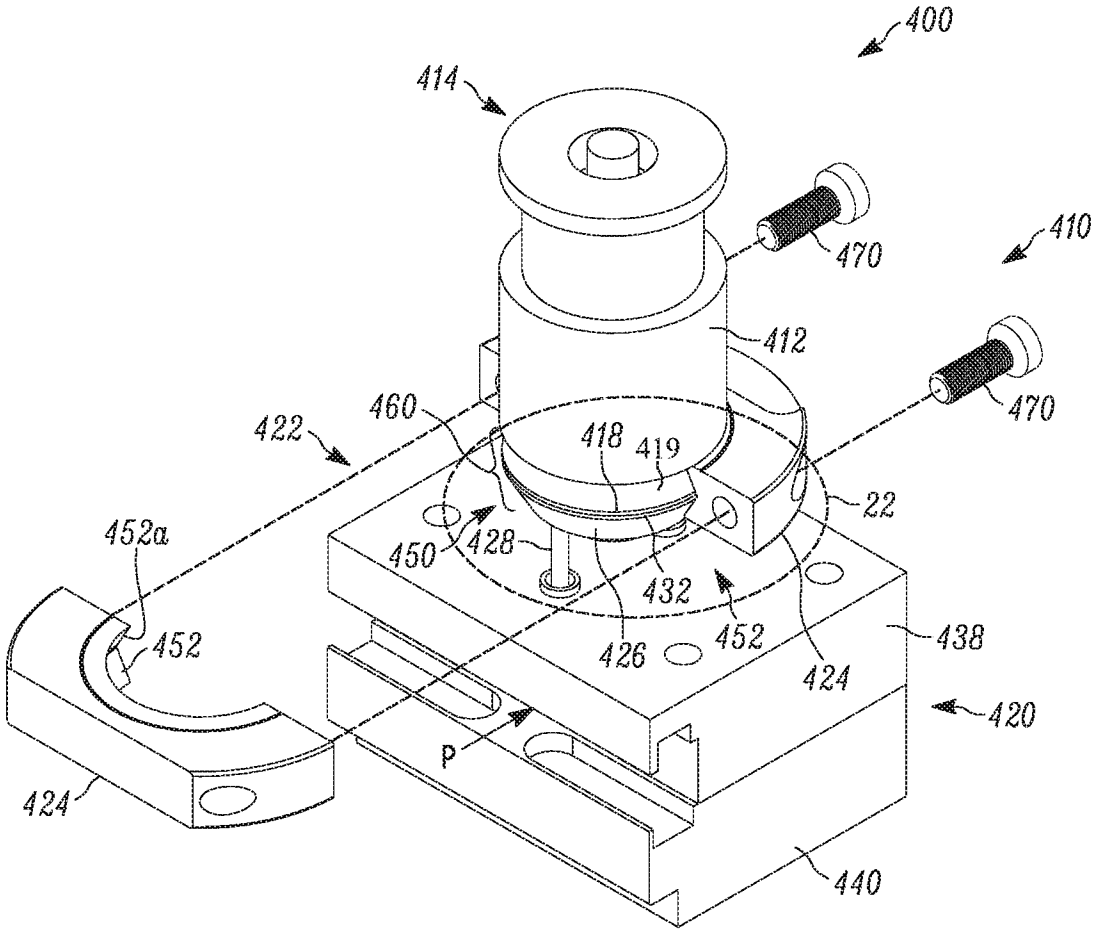
FIG. 21 is a front perspective view of a punch assembly comprising a second portion of a collar being attached to a first portion of the collar in accordance with one embodiment of the present disclosure.

As shown in the illustrated embodiment of FIGS. 18-21, during a change-over in size or to replace punch dies 428, 430 for maintenance, the operator removes the fasteners 470 that couple the first and second portions 424*a* and 424*b* of the collar 424 together. Once the fasteners 470 are removed, the die assembly 422, particularly the die support 426 and dies 428, 430 can be removed from the body 412 when the dies are in a stroke position out and above sleeves 480 and 482 located in the upper section 438 of the base arrangement 420. Alternatively as illustrated in FIG. 20, when the dies 428, 430 are in a lower stroke position, the dies and die support 426 can be removed along with the upper section 438 of the base arrangement 420. In one example embodiment, the upper section 438 is removed by lifting the upper section along a lateral direction L. Wherein the upper section 438 is coupled to the lower section 440 by a plurality of pins 437. Thus, the assembly 400 drastically reduces change-over time that typically required a plurality of fasteners, often more than 30 minutes in a conventional spacer frame punching assembly. The individual dies 428 and 430 are then removed from a corresponding recess 490 (see FIG. 17) located in the die support 426 and new dies are inserted into the support.

Figure 22:
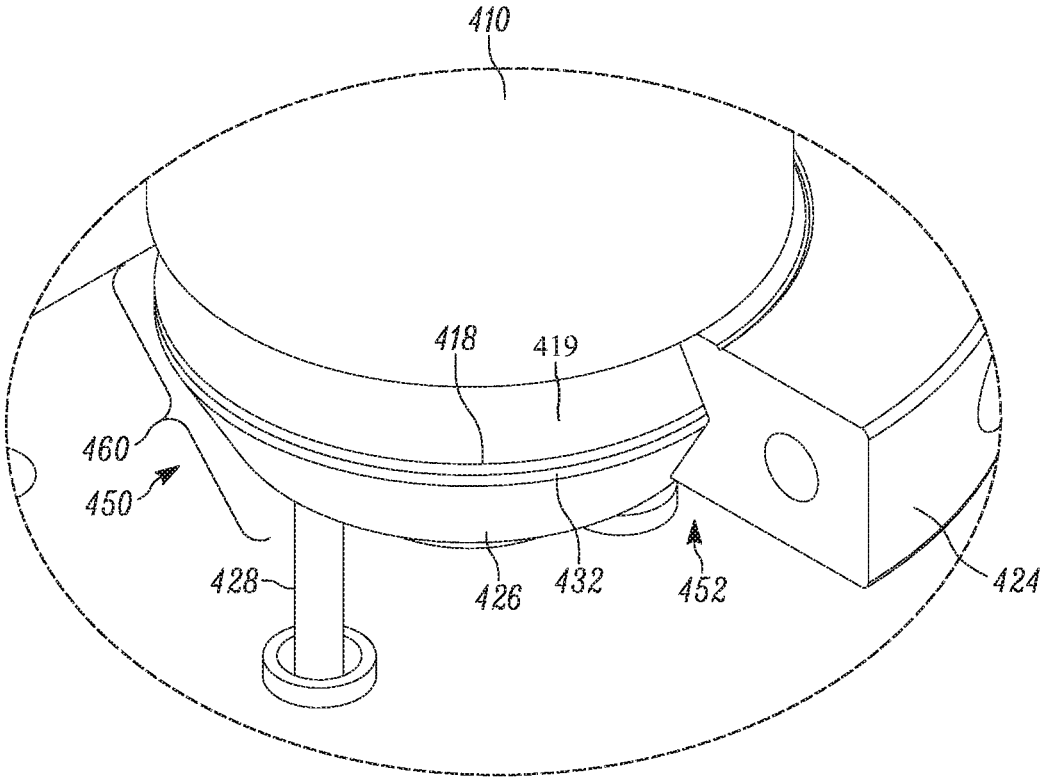
FIG. 22 is a magnified view of the section outlined by line 22 of FIG. 21.

As seen most particularly in FIG. 22, the annular torus shape 450 created by the wedge-shaped ridge 418 of the body 412 abutting the second wedge shaped ridge 432 of the die support 426 allows the load of the punch assembly 400 to be supported or borne by the corresponding surface 452 in the collar 424. In an example embodiment, the annular torus shape 450 comprising the contact region 460, supported by the recessed surface 452 of the collar 424, supports the load of the assembly 400 in the up and down strokes of the head assembly 412. Thus, such structure supports the constant cycle operation of the punch assembly 400 while providing a quick change in tooling with only two fasteners, saving time and operating costs associated with window spacer frame fabrication.

In the foregoing specification, specific embodiments have been described. However, one of ordinary skill in the art appreciates that various modifications and changes can be made without departing from the scope of the disclosure as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. In one non-limiting embodiment the terms are defined to be within for example 10%, in another possible embodiment within 5%, in another possible embodiment within 1%, and in another possible embodiment within 0.5%. The term "coupled" as used herein is defined as connected or in contact either temporarily or permanently, although not necessarily directly and not necessarily mechanically. A device or structure that is "configured" in a certain way is configured in at least that way, but may also be configured in ways that are not listed.

To the extent that the materials for any of the foregoing embodiments or components thereof are not specified, it is to be appreciated that suitable materials would be known by one of ordinary skill in the art for the intended purposes.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. An apparatus for fabricating a spacer frame used in construction of insulating glass unit windows, the apparatus comprising:

a head arrangement having a body with first and second ends, the first end for coupling to a cylinder that advances and retracts the head arrangement in a reciprocating motion during operation;

an annular die support having a second annular wedge-shaped ridge for coupling to an annular wedge-shaped ridge of the second end of the head arrangement, collectively the wedge-shaped ridge and the second annular wedge-shaped ridge form a contact region comprising an annular torus surface, the die support for supporting at least one die for back and forth movement in response to movement of said cylinder, the die support having the at least one die for engaging the spacer frame during operation; and a collar having an annular torus-shaped recess corresponding with a shape and a profile of the annular torus surface to nest and couple said body to said die support.

2. The apparatus of claim 1, wherein the collar comprises a first portion and a second portion coupled together by one or more fasteners.

3. The apparatus of claim 2, wherein the collar couples the body to the annular die support utilizing the one or more fasteners, wherein the fasteners generate tension to maintain a constant position of the die support relative to the collar and the second end.

4. The apparatus of claim 1, wherein responsive to removing the collar, the die support comprising the at least one die is uncoupled from the head arrangement.

5. The apparatus of claim 4, wherein responsive the die support being uncoupled from the head arrangement, the at least one die is detachable and at least one replacement die is attachable in place of the at least one die.

6. The apparatus of claim 1, wherein a first annular torus recessed surface of a first portion of the collar and a second annular torus recessed surface of a second portion of the collar mirror each other.

7. The apparatus of claim 6, wherein a first outer portion of the first portion of the collar and a second outer portion of the second portion of the collar comprise different dimensions.

8. The apparatus of claim 1, wherein the annular wedge-shaped ridge and the second annular wedge shaped ridge nest within a widest point of the annular torus-shaped recess of the collar.

9. The apparatus of claim 1, wherein the collar comprises a first portion and a second portion coupled together by two fasteners comprising threaded members, wherein the two fasteners are inserted through an oversized opening on the second portion to couple to a threaded opening on the first portion.

10. The apparatus of claim 1, comprising:

an upper portion, located opposite the second end of the head arrangement, through which the one or more dies travel toward the spacer frame; and a lower portion, located adjacent the upper portion opposite the head arrangement, wherein the spacer frame travels between the upper portion and the lower portion, and wherein, the upper portion is removable responsive to uncoupling the die support from the head arrangement.

11. A method of using an apparatus for forming a spacer frame assembly used in construction of insulating glass unit windows, the method comprising:

providing a head arrangement having a body with first and second ends, wherein the head arrangement advances and retracts in a reciprocating motion during operation, and wherein said second end of the head arrangement comprises an annular wedge-shaped ridge;

providing an annular die support having a second annular wedge-shaped ridge and at least one die for interacting with the spacer frame assembly;

coupling the annular wedge-shaped ridge to the second annular wedge-shaped ridge to form a contact region comprising an annular torus surface; and clamping the annular wedge-shaped ridge and second annular wedge-shaped ridge together.

12. The method of claim 11, wherein the clamping comprises fitting a first portion of a collar and a second portion of the collar having a recess configured to engage a portion of the annular torus surface and attaching the portions of said first and second portions of the collar together.

13. The method of claim 11, further comprising removing at least one fastener coupling a first and second portion of a collar together, the collar coupling the annular wedge-shaped ridge and the a second annular wedge-shaped ridge together;

removing the first and second portions of the collar from the second end and the annular die support;

uncoupling the annular die support from the second end of the head arrangement; and removing the at least one die from the annular support die.

14. The method of claim 11, comprising removing an upper portion, located adjacent the second end of the head arrangement, through which the one or more dies travel toward the spacer frame assembly, wherein the upper portion is removed from a lower portion, located adjacent the upper portion opposite the head arrangement, wherein the spacer frame assembly travels between the upper portion and the lower portion, and wherein, the upper portion is removed responsive to the at least one die extending into the upper portion when uncoupling occurs.

15. The method of claim 14, comprising:

placing the first and second portions of the collar around the coupled annular die support, comprising the at least one replacement die, and the second end of the body wherein, an annular torus recess of the collar nests with an annular torus surface formed by coupling the annular wedge-shaped ridge of the second end with the second annular wedge-shaped ridge of the annular die support; and inserting and fastening at least one fastener into the collar to secure the collar around the coupled annular support die and the second end, wherein the fasteners generate tension to maintain a constant position of the die support relative to the collar and the second end.

16. The method of claim 11, comprising coupling at least one replacement die to the annular die support in place of the at least one die; and coupling the annular die support comprising the at least one replacement die, to the second end of the body.

17. An apparatus for forming an aperture in a spacer frame assembly used in construction of insulating glass unit windows, the apparatus comprising:

a head arrangement having a body with first and second ends, the first end for coupling to a cylinder that advances and retracts the head arrangement in a reciprocating motion during operation;

an annular die support having a second annular wedge-shaped ridge for coupling to an annular wedge-shaped ridge of the second end of the head arrangement, collectively the wedge-shaped ridge and the second annular wedge-shaped ridge form a contact region comprising an annular torus surface, the die support for supporting at least one die for back and forth movement in response to movement of said cylinder, the die support having the at least one die for engaging the spacer frame during operation; and a collar having a first portion and a second portion coupled together by one or more fasteners wherein the fasteners generate tension to maintain a constant position of the die support relative to the collar and the second end, the collar having an annular torus-shaped recess corresponding with a shape and a profile of the annular torus surface to nest and couple said body to said die support, wherein the annular torus shaped recess comprises a first annular torus recessed surface of the first portion of the collar and a second annular torus recessed surface of the second portion of the collar, and wherein the first and second annular torus recessed surfaces mirror each other.

18. The apparatus of claim 17, wherein a first outer portion of the first portion of the collar and a second outer portion of the second portion of the collar comprise different dimensions.

19. The apparatus of claim 17, wherein responsive to removing the collar, the die support and the at least one die are uncoupled from the head arrangement and wherein responsive to the die support being uncoupled from the head arrangement, the at least one die is detachable and a replacement die is attachable in place of the at least one die.

20. The apparatus of claim 17, wherein the wedge-shaped ridge and the second wedge-shaped ridge nest within a widest point of the recessed surface comprised by the first and second annular torus recessed surfaces of the collar.

* * * * *